US006852177B2

(12) United States Patent
Kubota et al.

(10) Patent No.: US 6,852,177 B2
(45) Date of Patent: Feb. 8, 2005

(54) NI-BASED ALLOY IMPROVED IN OXIDATION-RESISTANCE, HIGH TEMPERATURE STRENGTH AND HOT WORKABILITY

(75) Inventors: Satoshi Kubota, Yasugi (JP); Toshihiro Uehara, Yonago (JP); Motoi Yamaguchi, Yasugi (JP); Akihiro Toji, Yasugi (JP)

(73) Assignee: Hitachi Metals Ltd., Tokyo (JP)

( * ) Notice: Subject to any disclaimer, the term of this patent is extended or adjusted under 35 U.S.C. 154(b) by 79 days.

(21) Appl. No.: 10/322,669

(22) Filed: Dec. 19, 2002

(65) Prior Publication Data

US 2003/0118469 A1 Jun. 26, 2003

(30) Foreign Application Priority Data

Dec. 21, 2001 (JP) ..... 2001-389965

(51) Int. Cl.[7] ..... C22C 19/05
(52) U.S. Cl. ..... 148/427; 148/428; 420/443
(58) Field of Search ..... 148/427, 428; 420/443

(56) References Cited

U.S. PATENT DOCUMENTS

| | | | |
|---|---|---|---|
| 3,660,177 A | | 5/1972 | Brown et al. |
| 4,614,550 A | | 9/1986 | Leonard et al. |

FOREIGN PATENT DOCUMENTS

| | | |
|---|---|---|
| EP | 1016733 A1 | 7/2000 |
| EP | 1065290 A1 | 1/2001 |
| JP | 63-153236 | 6/1988 |
| JP | 07268522 | 10/1995 |
| JP | 07-268522 | 10/1995 |
| JP | 10121170 | 5/1998 |
| JP | 11012670 | 1/1999 |
| JP | 2000336446 | 12/2000 |
| JP | 2000-336446 | 12/2000 |

OTHER PUBLICATIONS

European Search Report for application No. EP 02 02 8132 Mar. 3, 2003.

*Primary Examiner*—Sikyin Ip
(74) *Attorney, Agent, or Firm*—Sughrue Mion, PLLC

(57) ABSTRACT

A nickel-based alloy is provided for provide parts and members of improved oxidation-resistance and high temperature strength for use in an oxidation atmosphere at high temperatures, such as automobile parts including an electrode for an ignition plug, power plant facility parts including a gas turbine nozzle, inner parts of heat treat furnaces, and fuel cell parts. The alloy improved in oxidation-resistance, high temperature strength and hot workability consists essentially of, in mass percentage, C: 0.003 to 0.1%, Si: 1.0% or less, Mn: 2.0% or less, Cr: 12 to 32%, Fe: 20% or less, Mg: 0.001 to 0.04%, at least one element, of not more than 2.5% in total, selected from the group consisting of Nb, Ta and V, impurity elements of S: 0.01% or less, but the ratio of the Mg-content to the S-content (Mg/S) being 1 or more, and Ti: 0 inclusive to 0.02%, and the rest being Ni and incidental impurities.

13 Claims, 1 Drawing Sheet

NI-BASED ALLOY IMPROVED IN OXIDATION-RESISTANCE, HIGH TEMPERATURE STRENGTH AND HOT WORKABILITY

BACKGROUND OF THE INVENTION

1. Field of the Invention

The present invention relates to a Ni-based alloy improved in oxidation-resistance, high temperature strength and hot workability, which alloy is suitable for making parts and members used at high temperatures exposed to an oxidation atmosphere, including automobile parts such as ignition plug electrodes, power plant facility's parts such as gas turbine nozzles, inner parts of heat treatment furnaces, and fuel cell's parts.

2. Description of the Related Art

Conventionally, a Ni-18Cr-7Fe alloy (Alloy 600), which has a high oxidation-resistance, has been used for parts which are exposed in an oxidation atmosphere at high temperatures. Oxidation-resistance of a material is required to prevent volume loss or embrittlement of the material due to oxidation while being used at high temperature in air or gas atmosphere. The oxidation-resistance of Alloy 600 is maintained because a $Cr_2O_3$ layer is formed on its surface at a high temperature thus protecting the base metal.

Recently, there is a growing need for various parts having, oxidation-resistance at higher temperatures than required for conventional applications, and studies to improve Alloy 600 have been conducted. Japanese Patent Laid-Open Nos. 63-153236 and 2000-336446 have proposed an improvement on Alloy 600 in oxidation-resistance. Japanese Patent Laid-Open Nos. 7-268522 and 11-12670 have proposed an Alloy 600 based alloy having improved high temperature strength for making members required to have high temperature strength.

According to the above described Japanese Patent Laid-Open No. 63-153236, Alloy 600 is added with Y, Ce, Zr, Sc and/or La to improve its oxidation-resistance. However, this alloy had a problem in hot workability and cracking occurred during hot working. Accordingly, Japanese Patent Laid-Open No. 2000-336446 proposed by some of the present inventors discloses that in order to achieve a good oxidation-resistant alloy, rare-earth elements, Y, Hf and/or Zr are added to a base alloy based on Alloy 600, the base alloy being made by adding Mg for improving hot workability and contains no Ti thereby having improved oxidation resistance. These alloys disclosed in Japanese Patent Laid-Open Nos. 63-153236 and 2000-336446 basically exhibited high oxidation-resistance at high temperatures. However, these alloys did not have sufficient high temperature strength.

The above described Japanese Patent Laid-Open No. 7-268522 has proposed an alloy of which temperature strength is improved by adding more than a predetermined amount of W and Mo. However, this alloy had a problem in hot workability and cracking occurred during hot working. According to Japanese Patent Laid-Open No. 11-12670, although high temperature strength was improved by adding a small amount of Nb, Mo and W, this alloy also had a problem in hot workability resulting in cracking during hot processing.

These problems concerning high temperature strength and hot workability of the alloy present a big challenge for providing parts and members, which are to be practically used in an oxidation atmosphere at high temperatures, including automobile parts such as ignition plug electrodes, power plant facility's parts such as gas turbine nozzles, inner parts of heat treatment furnaces, and fuel cell's parts.

SUMMARY OF THE INVENTION

The object of the present invention is to provide parts and members improved in oxidation-resistance, high temperature strength and hot workability for use in an oxidation atmosphere at high temperatures, including automobile parts such as an ignition plug electrodes, power plant's facility parts such as gas turbine nozzles, inner parts of heat treatment furnaces, and fuel cell's parts.

The inventors of the present invention studied the above described problem of the high temperature strength and consequently have found that adding a small amount of one or more of Nb, Ta and V prevents the coarsening of austenite grains during hot working and heat treatment thus achieving fine austenite grains, and thereby strength deterioration during use at high temperatures is successfully suppressed.

However, containing one or more of Nb, Ta and V causes an increase in resistance to deformation of the matrix compared to a Ni-based alloy that does not contain these elements, and thus deterioration of strength of the grain boundaries easily results in surface cracks or fracture occurrence. Then the present inventors investigated the issue of hot workability and have found that to achieve an alloy free from defects such as surface cracks or fracture, it is essential to add Mg which serves effectively to improve hot workability due to the resultant, strong grain boundaries.

Furthermore, utilization of the precipitation hardening mechanism is contemplated to maintain a high temperature strength. Thus, it was found that adding Al that is a precipitation strengthening element in Ni-based alloys to an alloy containing at least one of Nb, Ta and V and added with Mg further improves the oxidation-resistance.

Thus, the present invention is a Ni-based alloy having improved oxidation-resistance, high temperature strength and hot workability, consisting essentially of, in mass percentage, C: 0.003 to 0.1%, Si: 1.0% or less, Mn: 2.0% or less, Cr: 12 to 32%, Fe: 20% or less, Mg: 0.001 to 0.04%, at least one element, of not more than 2.5% in total, selected from the group consisting of Nb, Ta and V, impurity elements of S: 0.01% or less, but the ratio of the Mg-content to the S-content (Mg/S) being 1 or more, and Ti: 0 inclusive to 0.02%, and the rest being Ni and incidental impurities.

In the present invention, to improve oxidation-resistance while placing an emphasis on ductility, Al of less than 2.0% in mass percentage may be contained.

When placing an emphasis on oxidation-resistance, Al of 2.0 to 5.0% in mass percentage may be contained.

Furthermore, in the present invention, at least one of Mo and W may be included as Mo+1/2W being 0.5% to 4.0%.

Furthermore, in the present invention, at least one of, in mass percentage, Hf: 1.5% or less and Zr: 1.0% or less, with the total of them being 0 inclusive to 2.0%, may be contained.

Furthermore, in the present invention, at least one of, in mass percentage, rare earth elements: 0.2% or less, Y: 0.5% or less and Sc: 0.2% or less, with the total of the rare earth elements, Y and Sc being 0.6% or less, may be included.

Furthermore, in the present invention, out of selective elements of Nb, Ta and V, Nb: 0.01 to 1.5% in mass percentage may be contained.

The present invention is a Ni-based alloy improved in oxidation-resistance, high temperature strength and hot workability wherein average diameters of circle equivalent to particle of compounds of Nb, Ta or V are preferably not more than 2.0 μm.

DETAILED DESCRIPTION OF THE PREFERRED EMBODIMENTS

Figure 1:
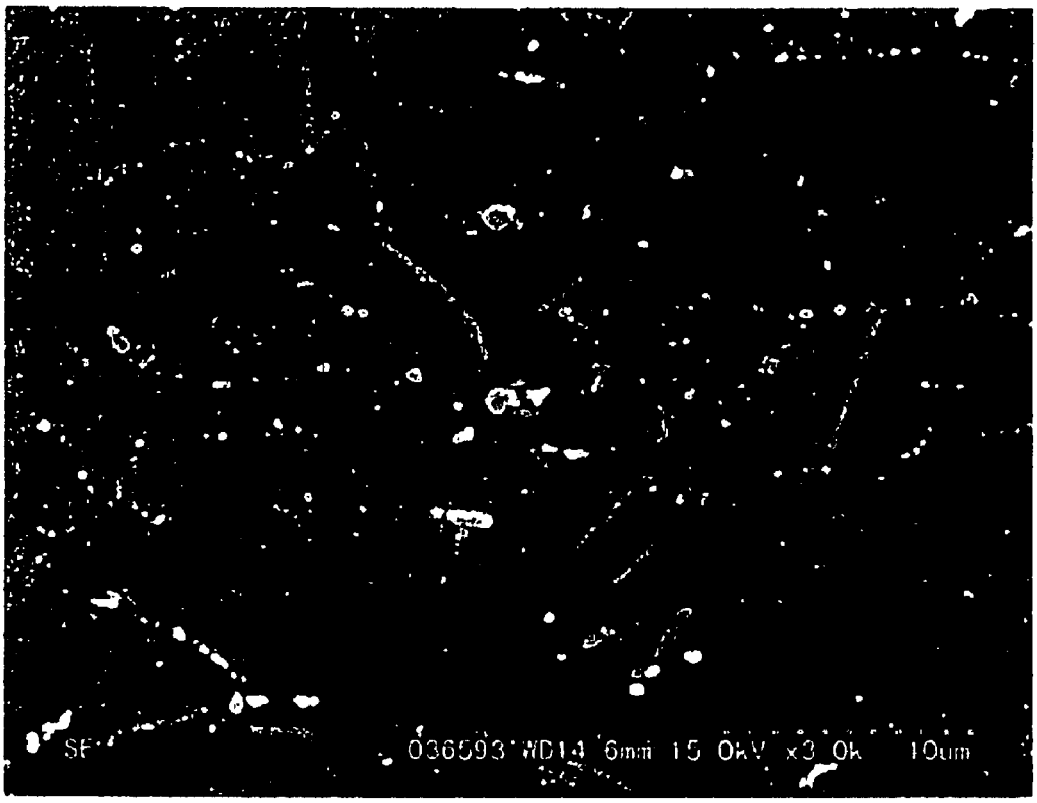
FIG. 1 is a microscope photograph of a section of the alloy of the present invention.

A significant feature of the present invention is its optimal chemical composition to enable an improvement in oxidation-resistance and high temperature strength, and an improvement in hot workability at the same time, which is based on Alloy 600 and added with a small amount of Nb, Ta and/or V, and which is further added with a very small amount of Mg as an essential content to fix S.

Hereinafter, effects of each element will be described.

C is effective in improving high temperature strength by forming carbides in conjunction with Nb, Ta and V and thereby preventing coarsening of austenite grains, and adding a small amount of C is necessary. However, excessive addition of C would cause cold workability deterioration due to a large amount of carbides formation, as well as oxidation-resistance deterioration due to carbide formation taking Cr out of the matrix thus causing shortage of Cr in the matrix. Therefore, C is limited to be 0.003 to 0.1%.

Si has a strong deoxidization effect on a molten metal and, in addition, effectively improves castability. Si also serves to prevent exfoliation of oxide layer by the formation of $SiO_2$ between the Cr oxide layer and the alloy matrix. For these reasons, Si is to be added; however, since excessive addition will cause a deterioration in oxidation-resistance, the upper limit of Si is set to be 1.0%. On the other hand, a desirable lower limit to achieve the above described effects of Si is 0.1%.

Mn, similar to Si, has a deoxidization effect as well as an effect of improving castability. However, since excessive addition of Mn will cause a deterioration in oxidation-resistance, the upper limit of Mn is set to be 2.0%. And a desirable lower limit for achieving the above described effects of Mn is 0.1%.

The presence of Cr in the alloy matrix causes a formation of a Cr oxide layer on the surface of the material at high temperatures thereby improving oxidation-resistance. To achieve a sufficient oxidation-resistance at temperatures of 700° C. to 1100° C., the lower limit of Cr needs to be 12% or more. However, excessive addition of Cr will reduce hot workability and also will lead to exfoliation of $Cr_2O_3$ layer in a high temperature oxidation atmosphere thereby reducing oxidation-resistance. Therefore, the upper limit of Cr is set to be 32%. Preferably, Cr is within 12 to 20%.

While Fe is an element which has a negative effect of reducing high temperature strength, Fe also contributes to excellent hot workability of the alloy of the present invention and is a necessary element for manufacturing. Excessive addition of Fe will reduce strength at high temperatures and also slightly reduce oxidation-resistance. In view of hot workability, the amount of Fe addition needs to be 20% or less, and preferably 12% or less.

Also, as a preferable lower limit of Fe, addition of 2% or more will be effective in maintaining a good hot workability.

Ti addition will cause a formation of an oxide layer in which Ti is included inside a Cr oxide layer, and thus facilitate the growth of the oxide layer resulting in a deterioration in oxidation-resistance. Therefore, Ti is undesirable, and it may be 0%. The tendency of Ti to impair oxidation-resistance becomes greater as Ti content exceeds 0.02%; therefore, the upper limit of Ti is set to be 0.02%, and preferably not more than 0.01%.

Nb, Ta and V are most important elements in the present invention, which form carbides in conjunction with C and thereby prevent coarsening of austenite grains during hot working and heat treatment, and which will decrease the size of the crystal grains of a product and increase high temperature strength. Nb, Ta and V are essential elements because their addition will increase the resistance to deformation of the matrix.

However, since excessive addition of them will impair hot workability and cold workability, the amount of addition is set to be not more than 2.5% in total of at least one of Nb, Ta and V and preferably not more than 2.0%. On the other hand, a preferable lower limit to achieve the effects of their addition is 0.01%.

Out of the selective elements (Nb, Ta and V) specified in the present invention, the element which is especially effective in decreasing austenite grain size is Nb. For this reason, it is preferable to add Nb as an essential element out of Nb, Ta and V.

However, excessive addition will impair hot workability and cold workability. On the other hand, when the amount of addition is excessively small, the refining of austenite grains by Nb will not be achieved. Therefore, the content of Nb is set to be within a range of 0.01% to 1.5%, and may preferably be 0.03 to 1.0%.

Since the soluble limit of S in Ni-matrix is very small, containing even a very small amount of S will result in segregation of $Ni_3S_2$ at grain boundaries and thus formation of an eutectic of Ni and $Ni_3S_2$. The melting point of this eutectic is very low, which becomes very brittle in the temperature range of hot working. Thus, S is an impurity element which will make grain boundaries brittle during hot working and cause cracking, thus reducing hot workability. Therefore, the content of S is limited to be 0.01% or less.

Mg has an effect of removing or fixing S by combining with S to form a compound, therefore it is specified as an essential element in the present invention. However, excessive addition of Mg will cause formation of $Ni_2Mg$ at grain boundaries since the solid solubility of Mg in Ni-matrix is small. Thus, an eutectic of Ni and $Ni_2Mg$ occurs at grain boundaries and makes the grain boundaries brittle during hot working thus reducing hot workability. Therefore, Mg addition is set to be 0.001 to 0.04%.

Moreover, in the present invention, there are cases in which occurrence of cracking caused by S cannot be prevented by simply adjusting the amount of S and Mg within the above described range. To reliably remove or fix S, a technique may be adopted in which the ratio of the Mg-content to the S-content (Mg/S) is controlled to be within a specific range. Specifically, when the value of Mg/S is 1 or more, it is possible to remove or fix S by means of Mg thus preventing cracking caused by S.

Al is an effective element in improving oxidation-resistance since it forms an oxide layer on the material surface; Al is also an effective deoxidation agent. But, on the other hand, excessive addition of Al will reduce cold workability, and therefore Al is to be added as needed.

For this reason, it is important to adjust the amount of Al addition taking following two cases into consideration.

First, when a sufficient oxidation-resistance is assured by Cr oxides alone, active addition of Al, which will impair cold workability, should be restricted. Also when a high ductility is needed, addition of Al should be restricted to be low since adding an excessive amount of Al will result in formation of fine precipitates of $Ni_3Al$ in the matrix thereby significantly reducing its ductility while increasing its high temperature strength. In such cases, Al may be adjusted to be less than 2.0% and more preferably 0.5% or less, and the addition may even be limited to be null.

Secondly, on the other hand, when the product is exposed in a severe environment, it is necessary to assure oxidation-resistance by adding Al to form Al oxide layer which is more effective as a protective film than that of Cr oxides. To this end, the lower limit of active addition of Al is set to be 2.0%, and the upper limit may be set to be 5.0%, and especially preferable range is from 2.0% to 4.0%.

Mo and W are kinds of elements which resolve in the matrix thereby increasing high temperature strength, and their effect can be adjusted by the amount Mo+1/2W. To achieve an improvement in high temperature, the value needs to be more than 0.5%. However, their excessive addition will reduce cold workability. To reliably ensure cold workability, the upper limits of Mo and W are specified as the value of Mo+1/2W being less than 4.0%.

Moreover, when adding Mo and W which will reduce cold workability, addition of Al, which also will reduce cold workability, is preferably limited to be less than 2.0% (preferably less than 0.5%). But, when Al of 2.0 to 5.0% is added to ensure the oxidation-resistance, Mo and W can be added with the upper limit of Mo+1/2W being 2.0% (preferably 1.0%) to improve a high temperature strength without a remarkable deterioration in cold workability.

Hf and Zr also combine with C to form carbides and thereby prevent the coarsening of the austenite grain during hot working and heat treatment. Thus, they are kinds of elements for maintaining fine grains of a product and also for maintaining high temperature strength. Moreover, they are also effective in improving the adhesion of oxide layer by partly resolving into the matrix and preventing the exfoliation of the oxide layer, thereby consequently improving the oxidation-resistance. However, since excessive addition will impair hot workability and cold workability, the upper limit of Hf is set to be less than 1.5%, and the upper limit of Zr is set to be less than 1.0%.

Adding rare earth elements, Y and Sc by very small amount will improve oxidation-resistance. Out of various rare earth elements which can be added in the present invention, preferable elements are La and Ce, which are considered to improve the adhesion of oxide layer.

However, their excessive addition will reduce hot workability. Therefore, the amount of addition is set to be 0.6% or less in total of at least one of rare earth elements of 0.2% or less, Y of 0.5% or less, and Sc of 0.2% or less.

Moreover, it is possible to further improve oxidation-resistance by adding Al at the same time, which will form Al oxide layer which has a strong effect as a protective film.

Furthermore, in the alloy of the present invention, following elements may be included within the range shown below in mass percentage.

$P \leqq 0.04$, $Cu \leqq 0.30$, $Ca \leqq 0.02$, $Co \leqq 2$, $N \leqq 0.03$, $O \leqq 0.005$ Furthermore, in the present invention, the average diameter of circle equivalent to particle of compounds of Nb, Ta and V is specified to be not more than 2.0 μm. The compounds include carbide and nitride. The reason is as follows.

Being finely dispersed in the material, the particles of the compounds of Nb, Ta and V prevent the coarsening of the austenite grains of the alloy of the present invention by a pinning effect while being heated, for example, at about 1050° C., consequently exerting its effect in gaining finer austenite grains.

To that end, a desirable average diameter of circle equivalent to particles of compounds of Nb, Ta and V is not more than 2.0 μm. Within this range, the particles of compounds of Nb, Ta and V will be in a finely dispersed state and will exert their effect in achieving fine austenite grains. If the average diameter of circle equivalent exceeds 2.0 μm, the amount of particles of compounds of Nb, Ta and V which exert pinning effect may become small, and thus the pinning effect will become insufficient thereby causing coarsening of austenite grains during high temperature heating. For that reason, in the present invention, the particle size of compounds of Nb, Ta and V is specified to be not more than 2.0 μm by average diameter of circle equivalent.

The lower limit of preferable particle size for exerting the greatest possible pinning effect is 1.0 μm by average diameter of circle equivalent.

The average diameter of circle equivalent used in the present invention indicates the diameter of a circle which has an area equivalent to the average area of compound particles. Measurements of average diameter of circle equivalent may be performed by observing at least 10 views in a cross section of a material at a magnification of 3000 by a scanning electron microscope and then conducting image analysis to determine the average diameter of circle equivalent.

One way to achieve the average diameter of circle equivalent to grains of compounds of Nb, Ta and V of not more than 2.0 μm as specified in the present invention is to increase the number of particles of compounds of Nb, Ta and V by, for example, fracturing them through plastic working and making them finely dispersed in the material.

To be more specific, it is possible to reliably fracture and disperse the compounds of Nb, Ta and V by applying plastic working to the material in such a way that a forging ratio (which equals to the ratio of sectional area before processing to sectional area after processing where the cross sections are taken in the direction perpendicular to the elongation of the material) of the plastic work is more than 9.

EXAMPLES

By means of vacuum melting, each ingot of 10 kg (W:90 mm×L:90 mm×H) was cast from the melt of each alloy, and the ingot was hot forged into a bar of W:26 mm×T:26 mm×L( for No. 3), W:29 mm×T:29 mm×L(for No. 4), W:30 mm×T:30 mm×L(for Nos. 1, 2, 5–33, 35, 36 and 38), W:40 mm×T:40 mm×L(for No. 34) and W:52 mm×T:52 mm×L (for No. 37), respectively, and thereafter the forged bars were subjected to a solution treatment for 1 hour at 950° C. and air cooled. Appearance of cracks in the forged bars was confirmed to evaluate hot workability.

After heat treating the bars under a high temperature environment (for 50 hours at 1050° C. in air) in which the austenite grains grew, the grain size number (ASTM number) was investigated. The results are shown in TABLE 3 to be described later.

The chemical compositions are shown in TABLE 1. Specimen Nos. 1 to 23 in TABLE 1 represent the alloys of the present invention, and specimen Nos. 30 to 38 in TABLE 2 represent comparative alloys. Also, modified Alloy 600s disclosed in Japan Patent Laid-Open Nos. 63-153236, 2000-336446, 7-268522, and 11-12670 are represented by Nos. 35, 36, 37 and 38, respectively.

TABLE 1

(mass %)

| No | C | Si | Mn | Cr | Fe | Ti | Al | Nb | Ta | V | Mo | W | Mo + ½ W | Mg | S | Mg/S | Other additives | Rest | Remarks |
|---|---|---|---|---|---|---|---|---|---|---|---|---|---|---|---|---|---|---|---|
| 1 | 0.042 | 0.31 | 0.31 | 12.4 | 7.2 | 0.01 | 0.21 | 0.51 | — | — | — | — | — | 0.004 | 0.002 | 2.0 | — | Ni and incidental impurities | Invention |
| 2 | 0.052 | 0.51 | 0.33 | 15.9 | 8.2 | — | 0.16 | 0.42 | — | — | — | — | — | 0.004 | 0.002 | 2.0 | — | Ni and incidental impurities | Invention |
| 3 | 0.035 | 0.32 | 0.32 | 17.2 | 7.8 | — | 0.23 | 0.68 | — | — | — | — | — | 0.006 | 0.002 | 3.0 | La 0.04 | Ni and incidental impurities | Invention |
| 4 | 0.039 | 0.41 | 0.43 | 30.2 | 7.9 | 0.01 | 0.30 | 0.56 | — | — | — | — | — | 0.020 | 0.004 | 5.0 | La 0.03 | Ni and incidental impurities | Invention |
| 5 | 0.034 | 0.40 | 0.37 | 15.9 | 16.4 | 0.02 | 0.30 | 0.75 | — | — | — | — | — | 0.012 | 0.003 | 4.0 | — | Ni and incidental impurities | Invention |
| 6 | 0.031 | 0.33 | 0.30 | 16.3 | 6.8 | — | 0.25 | 0.56 | — | — | 3.1 | — | 3.1 | 0.012 | 0.006 | 2.0 | — | Ni and incidental impurities | Invention |
| 7 | 0.042 | 0.35 | 0.34 | 16.4 | 7.0 | — | 0.21 | 1.25 | — | — | 2.8 | — | 2.8 | 0.008 | 0.005 | 1.6 | — | Ni and incidental impurities | Invention |
| 8 | 0.028 | 0.36 | 0.29 | 15.7 | 7.2 | — | — | 1.93 | — | — | 3.5 | — | 3.5 | 0.012 | 0.006 | 2.0 | — | Ni and incidental impurities | Invention |
| 9 | 0.035 | 0.42 | 0.25 | 16.5 | 7.2 | — | 0.20 | — | 0.81 | — | 3.1 | — | 3.1 | 0.010 | 0.004 | 2.5 | — | Ni and incidental impurities | Invention |
| 10 | 0.042 | 0.28 | 0.33 | 16.0 | 7.8 | — | 0.18 | — | — | 0.91 | 2.7 | — | 2.7 | 0.006 | 0.004 | 1.5 | — | Ni and incidental impurities | Invention |
| 11 | 0.043 | 0.40 | 0.44 | 16.2 | 8.4 | — | 0.34 | 0.52 | 1.02 | — | 3.3 | — | 3.3 | 0.009 | 0.003 | 3.0 | — | Ni and incidental impurities | Invention |
| 12 | 0.036 | 0.36 | 0.38 | 15.6 | 8.1 | 0.02 | 0.25 | 0.51 | — | — | 1.0 | 4.0 | 3.0 | 0.012 | 0.006 | 2.0 | — | Ni and incidental impurities | Invention |
| 13 | 0.050 | 0.30 | 0.52 | 15.8 | 7.5 | 0.02 | 0.27 | 0.81 | — | — | 2.1 | 3.2 | 3.7 | 0.010 | 0.005 | 2.0 | La 0.04 | Ni and incidental impurities | Invention |
| 14 | 0.035 | 0.41 | 0.44 | 16.4 | 8.2 | 0.02 | 0.24 | 0.55 | — | — | 3.1 | — | 3.1 | 0.005 | 0.003 | 1.7 | Zr 0.06 | Ni and incidental impurities | Invention |
| 15 | 0.033 | 0.39 | 0.40 | 16.2 | 8.1 | 0.02 | 0.22 | 0.46 | — | — | 2.6 | — | 2.6 | 0.007 | 0.002 | 3.5 | Hf 0.11 | Ni and incidental | Invention |

TABLE 1-continued (mass %)

| No | C | Si | Mn | Cr | Fe | Ti | Al | Nb | Ta | V | Mo | W | Mo + ½ W | Mg | S | Mg/S | Other additives | Rest | Remarks |
|---|---|---|---|---|---|---|---|---|---|---|---|---|---|---|---|---|---|---|---|
| | | | | | | | | | | | | | | | | | | impurities | |
| 16 | 0.031 | 0.28 | 0.43 | 16.3 | 7.4 | 0.01 | 0.30 | 0.05 | — | — | — | — | — | 0.011 | 0.005 | 2.2 | La 0.03 Zr 0.05 | Ni and incidental impurities | Invention |
| 17 | 0.041 | 0.30 | 0.33 | 16.1 | 7.5 | 0.02 | — | 1.05 | — | — | 3.2 | — | 3.2 | 0.015 | 0.003 | 5.0 | La 0.04 | Ni and incidental impurities | Invention |
| 18 | 0.031 | 0.28 | 0.43 | 16.3 | 7.4 | 0.01 | 2.6 | 0.66 | — | — | — | — | — | 0.010 | 0.005 | 2.0 | — | Ni and incidental impurities | Invention |
| 19 | 0.040 | 0.30 | 0.31 | 12.6 | 7.7 | 0.01 | — | 0.50 | — | — | — | — | — | 0.005 | 0.002 | 2.5 | — | Ni and incidental impurities | Invention |
| 20 | 0.051 | 0.49 | 0.32 | 16.0 | 8.0 | — | — | 0.41 | — | — | — | — | — | 0.004 | 0.002 | 2.0 | — | Ni and incidental impurities | Invention |
| 21 | 0.013 | 0.31 | 0.30 | 15.4 | 7.3 | — | 3.0 | 0.35 | — | — | — | — | — | 0.006 | 0.004 | 1.5 | La 0.04 | Ni and incidental impurities | Invention |
| 22 | 0.015 | 0.30 | 0.31 | 16.0 | 7.0 | — | 2.7 | 0.30 | — | — | 1.8 | — | 1.8 | 0.010 | 0.002 | 5.0 | La 0.03 Zr 0.05 | Ni and incidental impurities | Invention |
| 23 | 0.033 | 0.32 | 0.30 | 16.5 | 7.5 | — | 0.21 | 0.06 | — | — | 3.2 | — | 3.2 | 0.020 | 0.005 | 4.0 | La 0.03 Zr 0.04 | Ni and incidental impurities | Invention |

Notes)
—: Not added

TABLE 2

(mass %)

| No | C | Si | Mn | Cr | Fe | Ti | Al | Nb | Ta | V | Mo | W | Mo + ½ W | Mg | S | Mg/S | Other additives | Rest | Remarks |
|---|---|---|---|---|---|---|---|---|---|---|---|---|---|---|---|---|---|---|---|
| 30 | 0.161 | 0.30 | 0.25 | 16.1 | 7.6 | 0.21 | 0.28 | 0.55 | — | — | — | — | — | 0.010 | 0.005 | 2.0 | — | Ni and incidental impurities | Comparative example |
| 31 | 0.042 | 0.25 | 0.32 | 10.1 | 7.5 | 0.33 | 0.44 | 0.61 | — | — | — | — | — | 0.012 | 0.005 | 2.4 | — | Ni and incidental impurities | Comparative example |
| 32 | 0.035 | 0.32 | 0.41 | 33.1 | 7.6 | 0.25 | 0.25 | 0.46 | — | — | — | — | — | 0.008 | 0.005 | 1.6 | — | Ni and incidental impurities | Comparative example |
| 33 | 0.028 | 0.31 | 0.33 | 16.4 | 20.6 | 0.27 | 0.33 | 0.45 | — | — | — | — | — | 0.009 | 0.003 | 3.0 | — | Ni and inci- | Comparative |

TABLE 2-continued

| No | C | Si | Mn | Cr | Fe | Ti | Al | Nb | Ta | V | Mo | W | Mo + ½ W | Mg | S | Mg/S | Other additives | Rest | Remarks |
|---|---|---|---|---|---|---|---|---|---|---|---|---|---|---|---|---|---|---|---|
| | | | | | | | | | | (mass %) | | | | | | | | | |
| | | | | | | | | | | | | | | | | | | dental impurities | example |
| 34 | 0.006 | 0.36 | 0.41 | 16.5 | 7.6 | 15.2 | 0.32 | 0.81 | — | — | — | — | — | 0.008 | 0.002 | 4.0 | — | Ni and incidental impurities | Comparative example |
| 35 | 0.042 | 0.29 | 0.46 | 16.2 | 8.1 | 0.17 | 0.44 | — | — | — | — | — | — | — | 0.002 | — | Y 0.03 | Ni and incidental impurities | Comparative example |
| 36 | 0.026 | 0.37 | 0.37 | 15.7 | 7.9 | — | 0.51 | — | — | — | — | — | — | 0.008 | 0.002 | 4.0 | La 0.04 | Ni and incidental impurities | Comparative example |
| 37 | 0.030 | 0.36 | 0.41 | 16.5 | 7.6 | 0.15 | 0.32 | 2.4 | — | — | 6.5 | 3.2 | 8.1 | — | 0.004 | — | — | Ni and incidental impurities | Comparative example |
| 38 | 0.025 | 0.28 | 0.31 | 15.8 | 7.2 | 0.23 | 0.31 | 0.15 | — | — | 0.16 | — | 0.16 | — | 0.005 | — | — | Ni and incidental impurities | Comparative example |

Notes)
—: Not added

Next, test pieces for tensile test and oxidation-resistance test were machined from the materials shown in TABLES 1 and 2 to be tested. As the test for a high temperature strength, high temperature tensile tests at 800° C. were performed according to a test method specified by ASTM: E21 to determine a high temperature tensile strength of the materials. The high temperature strength is estimated to be good if high temperature tensile strength at 800° C. is not lower than 200 MPa.

The oxidation-resistance tests were performed using specimens of 10 mm diameter and 20 mm long for 100 hours at 1050° C. in air and the oxidation-resistances were evaluated by the average weight gains by oxidation after heating. When the weight gain by oxidation per unit surface area is not more than 25 g/m$^2$, it is considered to be a good oxidation-resistance. The austenite grain size number of each oxidation-resistance test piece was observed according to a test method specified by ASTM: E112 before and after the oxidation-resistance test to investigate the changes in the grain size number. The change of grain size number is determined by the difference between that before the oxidation-resistance test and that after the oxidation-resistance test, a positive larger number indicating more growth of the austenite grain.

Furthermore, the specimens which had been subjected to the oxidation-resistance tests were tested on a plane corresponding to a longitudinal cross section in the direction perpendicular to elongation by forging by means of an electron microscope to observe 10 views of compound particles of Nb, Ta and V at a magnification of 3000 to determine the average diameter of circle equivalent.

There were some materials in which a forging crack occurred; for such materials, specimens were prepared by machining them from a part of the material which is free from cracks and applying solution heat-treatment to them.

The results of high temperature tensile test, oxidation-resistance test, changes in grain size number, forging ratio, average diameter of circle equivalent of Nb, Ta and V compounds, and the results of the above described hot workability (cracks) are summarized in TABLE 3.

TABLE 3

| No | Tensile strength (MPa) at 800° C. | Oxidation weight gain (g/m$^2$) 1050° C. × 100 h | Changes in grain size number | Forging ratio | Av. dia. of circle equivalent of Nb, Ta and V-compound (μm) | Hot workability (Cracked or not) | Remarks |
|---|---|---|---|---|---|---|---|
| 1 | 212 | 15 | 9 | 9 | 0.8 | Good (Not cracked) | Invention |
| 2 | 215 | 14 | 9 | 9 | 0.8 | " | " |
| 3 | 217 | 6 | 9.5 | 12 | 0.1 | " | " |

TABLE 3-continued

| No | Tensile strength (MPa) at 800° C. | Oxidation weight gain ($g/m^2$) 1050° C. × 100 h | Changes in grain size number | Forging ratio | Av. dia. of circle equivalent of Nb, Ta and V-compound (μm) | Hot workability (Cracked or not) | Remarks |
|---|---|---|---|---|---|---|---|
| 4 | 209 | 7 | 8.5 | 10 | 0.6 | " | " |
| 5 | 208 | 16 | 9 | 9 | 0.8 | " | " |
| 6 | 222 | 15 | 9 | 9 | 0.8 | " | " |
| 7 | 233 | 13 | 9.5 | 9 | 0.9 | " | " |
| 8 | 241 | 12 | 9.5 | 9 | 0.9 | " | " |
| 9 | 226 | 12 | 9 | 9 | 0.8 | " | " |
| 10 | 224 | 15 | 9 | 9 | 0.8 | " | " |
| 11 | 245 | 14 | 9 | 9 | 0.8 | " | " |
| 12 | 220 | 17 | 9 | 9 | 0.8 | " | " |
| 13 | 225 | 8 | 9 | 9 | 0.8 | " | " |
| 14 | 219 | 8 | 9 | 9 | 0.8 | " | " |
| 15 | 223 | 9 | 9 | 9 | 0.8 | " | " |
| 16 | 200 | 6 | 9.5 | 9 | 0.2 | " | " |
| 17 | 228 | 8 | 9.5 | 9 | 0.9 | " | " |
| 18 | 209 | 5 | 9 | 9 | 0.8 | " | " |
| 19 | 208 | 17 | 9 | 9 | 0.8 | " | " |
| 20 | 204 | 16 | 9 | 9 | 0.8 | " | " |
| 21 | 220 | 4 | 9 | 9 | 0.8 | " | " |
| 22 | 236 | 4 | 9 | 9 | 0.8 | " | " |
| 23 | 215 | 8 | 9 | 9 | 0.8 | " | " |
| 30 | 214 | 45 | 9 | 9 | 0.8 | " | Comparative |
| 31 | 203 | 112 | 9.5 | 9 | 0.8 | " | " |
| 32 | 217 | 41 | 9 | 9 | 0.8 | " | " |
| 33 | 182 | 32 | 9 | 9 | 0.8 | " | " |
| 34 | 207 | 36 | 9.5 | 5 | 0.8 | " | " |
| 35 | 166 | 10 | 14 | 9 | — | Cracked partially | " |
| 36 | 158 | 8 | 13.5 | 9 | — | Good (Not cracked) | " |
| 37 | 125 | 22 | 16.5 | 3 | 2.6 | Forging cracked | " |
| 33 | 194 | 24 | 9.5 | 9 | 0.8 | Cracked partially | " |

TABLE 3 reveals that the alloys of the present invention (Nos. 1 to 23) have excellent high temperature strengths as indicated by high tensile strengths (200 MPa or more) at a high temperature (800° C.), a good oxidation-resistance as indicated by the oxidation weight gains of 25 $g/m^2$ or less in the oxidation-resistance test at 1050° C. for 100 hours in air, and a good hot workability as indicated by non-existence of cracks by forging, at the same time.

Especially, the alloy Nos. 18, 21 and 22 in which Al is actively added showed oxidation weight gains of 5 $g/m^2$ or less, indicating that they have excellent oxidation-resistance among other alloys of the present invention. The alloy Nos. 21 and 22 in which a large amount of Al and La are added showed oxidation weight gains of as low as 4 $g/m^2$ indicating that they have the best oxidation-resistances.

An electron micrograph of the alloy No. 7 of the present invention is shown in FIG. 1. It is seen in the Figure that Nb compounds (Nb carbides) seen at the center of the photograph are being fractured by plastic working. These fractured carbides were observed in each alloy of the present invention.

A correlation between the change in grain size number and the high temperature strength was observed indicating an effect that the dispersed Nb carbides prevented the austenite grain growth at a high temperature thus preventing the deterioration of high temperature strength.

On the other hand, the comparative materials showed that, when C is more than 0.1% as in No. 30, shortage of Cr occurs causing a deterioration of oxidation-resistance. When Cr is less than 12% as in No. 31, oxidation weight gain increases and oxidation-resistance is reduced significantly. Also when Cr is more than 32% as in No. 32, the oxide layer is susceptible to exfoliation and oxidation weight gain increases and thereby causes reducing oxidation-resistance.

When Fe is more than 20% as in No. 33, tensile strength at 800° C. is significantly reduced and high temperature strength is significantly reduced. Oxidation-resistance is also reduced slightly. When Ti is more than 1.0% as in No. 34, the growth of oxide layer is facilitated thereby increasing the oxidation weight gain, and thus oxidation-resistance is reduced.

The alloy (No. 35) which is disclosed in Japanese Patent Laid-Open No. 63-153236 in which Nb, Ta and V are not added showed a tensile strength of far lower than 200 MPa at 800° C. indicating a poor high temperature strength. In this alloy, cracking occurred during hot working. The alloy (No. 36) disclosed in Japanese Patent Laid-Open No. 2000-336446 in which Nb, Ta and V are not added showed a large change in the grain size number and a tensile strength of far less than 200 MPa at 800° C. indicating a very low high temperature strength in spite of its high forging ratio. The alloy (No. 37) disclosed in Japanese Patent Laid-Open No. 7-268522 in which Mo+1/2W is not less than 4% and Mg is not added showed severe cracking during hot working. The alloy (No. 38) disclosed in Japanese Patent Laid-Open No. 11-12670 in which Mg is not added also showed cracking during hot working.

According to the present invention, the problem concerning high temperature strength and hot workability is improved thereby substantially contributing to increasing the lives of parts and members used at high temperatures exposed to oxidation atmosphere including automobile parts such as ignition plug electrodes, power plant facility's parts such as gas turbine nozzles, inner parts of heat treatment furnaces, and fuel cell's parts.

The Ni-based alloy of the present invention is most suitable for electrode materials for ignition plugs and capsule materials for fuel cells.

What is claimed is:

1. A nickel-based alloy improved in oxidation-resistance, high temperature strength and hot workability consisting essentially of, in mass percentage, C: 0.003 to 0.1%, Si: 1.0% or less, Mn: 2.0% or less, Cr: 12 to 32%, Fe: 20% or less, Al: less than 2.0%, Mg: 0.001 to 0.04%, at least one element, of not more than 2.5% in total, selected from the group consisting of Nb, Ta and V, impurity elements of S: 0.01% or less, but the ratio of the Mg-content to the S-content being 1 or more, and Ti: 0 inclusive to 0.02%, and the rest being Ni and incidental impurities, wherein an average diameter of a circle equivalent to a compound particle of Nb, Ta and V is not more than 2.0 $\mu$m.

2. A nickel-based alloy improved in oxidation-resistance, high temperature strength and hot workability as set forth in claim 1, further containing at least one of Mo and W as Mo+1/2W being 0.5% to 4.0%.

3. A nickel-based alloy improved in oxidation-resistance, high temperature strength and hot workability as set forth in claim 1, further containing at least one of rare earth elements: 0.2% or less, Y: 0.5% or less and Sc: 0.2% or less, but the total amount of rare earth elements, Y and Sc being 0.6% or less.

4. A nickel-based alloy improved in oxidation-resistance, high temperature strength and hot workability as set forth in claim 1, further containing at least one of Mo and W as Mo+1/2W being 0.5% to 4.0%, at least one of Hf: 1.5% or less and Zr: 1.0% or less, but the total amount of Hf and Zr being 0 inclusive to 2.0%, and at least one of rare earth elements: 0.2% or less, Y: 0.5% or less and Sc: 0.2% or less, but the total amount of rare earth elements, Y and Sc being 0.6% or less.

5. A nickel-based alloy improved in oxidation-resistance, high temperature strength and hot workability as set forth in claim 1, wherein the Al content is 0.5% or less.

6. A nickel-based alloy improved in oxidation-resistance, high temperature strength and hot workability as set forth in claim 1, wherein the Nb content is 0.01 to 1.5%.

7. A nickel-based alloy improved in oxidation-resistance, high temperature strength and hot workability as set forth in claim 1, further containing at least one of Hf: 1.5% or less and Zr: 1.0% or less, but the total amount of Hf and Zr being 0 inclusive to 2.0%, and at least one of rare earth elements: 0.2% or less, Y: 0.5% or less and Sc: 0.2% or less, but the total amount of rare earth elements, Y and Sc being 0.6% or less.

8. A nickel-based alloy improved in oxidation-resistance, high temperature strength and hot workability as set forth in claim 1, further containing at least one of Mo and W as Mo+1/2W being 0.5% to 4.0%, and at least one of rare earth elements: 0.2% or less, Y: 0.5% or less and Sc: 0.2% or less, but the total amount of rare earth elements, Y and Sc being 0.6% or less.

9. A nickel-based alloy improved in oxidation-resistance, high temperature strength and hot workability as set forth in claim 1, further containing at least one of Mo and W as Mo+1/2W being 0.5% to 4.0%, and at least one of Hf: 1.5% or less and Zr: 1.0% or less, but the total amount of Hf and Zr being 0 inclusive to 2.0%.

10. A nickel-based alloy improved in oxidation-resistance, high temperature strength and hot workability consisting essentially of, in mass percentage, C: 0.003 to 0.1%, Si: 1.0% or less, Mn: 2.0% or less, Cr: 12 to 32%, Fe: 20% or less, Al: 2.0 to 5.0%, Mg: 0.001 to 0.04%, at least one element, of not more than 2.5% in total, selected from the group consisting of Nb, Ta and V, impurity elements of S: 0.01% or less, but the ratio of the Mg-content to the S-content being 1 or more, and Ti: 0 inclusive to 0.02%, and the rest being Ni and incidental impurities, wherein an average diameter of a circle equivalent to a compound particle of Nb, Ta and V is not more than 2.0 $\mu$m.

11. A nickel-based alloy improved in oxidation-resistance, high temperature strength and hot workability as set forth in claim 10, further containing at least one of rare earth elements: 0.2% or less, Y. 0.5% or less and Sc: 0.2% or less, but the total amount of rare earth elements, Y and Sc being 0.6% or less.

12. A nickel-based alloy improved in oxidation-resistance, high temperature strength and hot workability as set forth in claim 10, further containing at least one of Mo and W as Mo+1/2W being 0.5% to 2.0%, at least one of Hf: 1.5% or less and Zr: 1.0% or less, but the total amount of Hf and Zr being 0 inclusive to 2.0%, and at least one of rare earth elements: 0.2% or less, Y: 0.5% or less and Sc: 0.2% or less, but the total amount of rare earth elements, Y and Sc being 0.6% or less.

13. A nickel-based alloy improved in oxidation-resistance, high temperature strength and hot workability as set forth in claim 10, wherein the Nb content is 0.01 to 1.5%.

* * * * *